US007967293B2

(12) United States Patent
Sorge

(10) Patent No.: US 7,967,293 B2
(45) Date of Patent: Jun. 28, 2011

(54) POKER DICE GAME

(76) Inventor: Nicholas Sorge, Deer Park, NY (US)

( * ) Notice: Subject to any disclaimer, the term of this patent is extended or adjusted under 35 U.S.C. 154(b) by 23 days.

(21) Appl. No.: 12/215,724

(22) Filed: Jun. 30, 2008

(65) Prior Publication Data

US 2009/0322024 A1 Dec. 31, 2009

(51) Int. Cl.
*A63F 9/04* (2006.01)

(52) U.S. Cl. ..... 273/146; 273/274

(58) Field of Classification Search ..... 273/146, 273/274, 292

See application file for complete search history.

(56) References Cited

U.S. PATENT DOCUMENTS

| | | | | |
|---|---|---|---|---|
| 614,524 | A * | 11/1898 | Yardley | 273/146 |
| 4,258,919 | A * | 3/1981 | Martelli | 273/146 |
| 5,662,330 | A * | 9/1997 | Spears | 273/274 |
| 7,032,901 | B2 | 4/2006 | Perrie et al. | |
| 7,334,792 | B1 | 2/2008 | Bermann | |
| 7,341,250 | B2 | 3/2008 | Lewis, Jr. | |
| 2001/0022430 | A1 | 9/2001 | Promutico | |
| 2001/0048196 | A1 | 12/2001 | Au-Yeung | |
| 2003/0062672 | A1 | 4/2003 | Sloper | |
| 2006/0061036 | A1 * | 3/2006 | VanZanten | 273/292 |
| 2006/0066050 | A1 | 3/2006 | Sorge | |
| 2007/0052174 | A1 | 3/2007 | Dargue | |

* cited by examiner

*Primary Examiner* — Benjamin H Layno
(74) *Attorney, Agent, or Firm* — Scully, Scott, Murphy & Presser, P.C.

(57) ABSTRACT

The present invention relates to a game of dice wherein each player (i) draws a hand of at least three dice, wherein each die possesses a number of sides, an equivalent number of consecutive numerical values with one numerical value per side, and a suit, the suits being ranked from highest suit rank to lowest suit rank, wherein each side and numerical value in a die is associated with said suit; wherein the dice in a hand are of different suits, none having the same suit, but all of the dice in a hand having the same number of sides and numerical values; and (ii) compares the hand to an established ranking system of hands to determine the hand of highest rank, wherein the hand of highest rank is deemed the winner.

17 Claims, 1 Drawing Sheet
(1 of 1 Drawing Sheet(s) Filed in Color)

POKER DICE GAME

FIELD OF THE INVENTION

The present invention relates generally to the field of board games, and more specifically, to board games played with dice.

BACKGROUND OF THE INVENTION

The game of poker is highly popular and widely enjoyed both in private settings and in commercial gambling establishments (i.e., casinos). The game is traditionally played using playing cards. The playing cards typically contain 52 cards with numerical ranks from 2 to 10 and pictorial cards of Jack, Queen, King, and Ace. In addition, some games utilize two additional cards (e.g., pokers). The Ace card can function as either a value equal to "11", or as the number "1". The playing cards are also organized into four suits, i.e., the spades, clubs, hearts, and diamonds varieties of each numerical and pictorial type of card.

The game is typically played by having each player draw (or be dealt) five cards for one game of play (otherwise known as "a play"). Each player studies the cards in his or her possession (i.e., the player's "hand") to determine whether the hand contains a combination of cards that falls within one of several categories of ranked combinations. The categories of ranked combinations together comprise the "ranking system of hands." This ranking system ranks the hands by assigning a highest value to one type of card combination and successively lowers values to other card combinations. A player that possesses a hand of highest value (i.e., of highest rank) for a play wins the play. Often, each play involves the placing of a wager by each player, either with playing chips, tender, or both.

The standard ranking system for poker typically comprises the following combinations ranked from highest to lowest value: a "royal flush" in which the hand contains an ace, king, queen, jack, and 10, all of the same suit; a "straight flush" in which the hand contains five consecutively-ranked cards (e.g., 10, 9, 8, 7, and 6), all of the same suit, but being different than the royal flush in card combination; a "four of a kind" in which the hand contains four cards of the same rank (e.g., four "nines" and one king) across the four suits; a "full house" (or "full boat") in which the hand contains three cards of one rank and two cards of a different rank, regardless of suit (e.g., three "fives" and two "sevens"); a "flush" in which the hand contains all five cards of a single suit, regardless of card ranks (e.g., a "two," "six," "eight," jack, and queen, all of clubs); a "straight" in which the hand contains five consecutively-ranked cards, regardless of suit (e.g., "seven of clubs," "eight of diamonds," "nine of clubs," "ten of hearts," and "jack of hearts"); a "three of a kind" in which the hand contains three cards of the same rank (e.g., three aces) across three suits; a "two pair" in which the hand contains a pair of one type of card and a pair of another type of card, regardless of suits (e.g., two "twos" and two "fours"); a "pair" (or "one pair") in which the hand contains a pair of one type of card (e.g., two queens); and "nothing" (or "high card" or "no pair") in which the hand does not contain any of the types of combinations described above.

There are numerous variations of the type of poker described above. For example, there are three-card and seven-card versions of poker. Some particularly popular poker variants include Draw Poker, Stud Poker, and community card poker. In Draw Poker variations (e.g., Five-Card Draw), players' hands are hidden and each player is provided the opportunity to replace their cards from cards remaining in the pack. In Stud Poker variations (e.g., Five-Card and Seven-Card Stud), players' hands are partially hidden and each player is dealt a predetermined number of cards that cannot be replaced. In community card poker variants (e.g., Texas hold 'em and Omaha hold 'em), players are allowed to match a certain number of cards set on the table (community cards) with a certain number of cards that a player possesses in order to make a best hand. The cards dealt to players in community card games are typically hidden (face down) from other players while community cards are seen by all players. The variations of poker above can be further varied by the rules governing winners and losers. For example, in the high-low split variant, the highest and lowest hands split the total amount wagered (i.e., the "pot"). In lowball poker, the lowest hand wins. In yet other poker variants, wild cards are added.

There is also a dice version of poker in which, typically, six-sided dice contain representations of six types of playing cards, i.e., typically ace, king, queen, jack, ten and nine. In one version, the poker dice lack suits, and thus, a "royal flush" or "straight flush" is not possible. In another version, the poker dice include suits wherein each die contains six types of playing cards and a number of different suits. See, for example, U.S. Pat. No. 4,258,919.

Numerous other dice games are highly popular, including, for example, Yahtzee and Kismet. In Yahtzee, five conventional six-sided dice (i.e., each die designating numbers one through six) are rolled by a player and a score is correlated to a particular repeat or pattern of numbers. For example, a hand having three or four of the dice showing the same number is assigned a score, which is the sum of all numbers shown by the rolled dice. Kismet utilizes conventional six-sided dice as above, except that each die possesses sides of different colors (e.g., ones and sixes are black, twos and fives are red, and threes and fours are green, on each die). The scoring in Kismet is similar to Yahtzee except that the colors allow for additional winning combinations. For example, in Kismet, two pairs of numbers having the same color (e.g., a pair of black ones and pair of black sixes, with the fifth die being any color or number) can be scored as a "four of a kind" in imitation of poker. Kismet can also imitate several other poker hands in similar fashion.

However, there would be added enjoyment in a game of dice, which simulates poker in an exciting and new manner by using an innovative game set of dice particularly constructed for this purpose.

SUMMARY OF THE INVENTION

The invention is directed to a method of playing a modified game of poker using dice, wherein each die in a hand is associated with a single suit, and wherein dice in a hand are all of different suits. Accordingly, a player cannot draw a hand of dice wherein two or more of the dice are of the same suit. A suit designation can take any suitable form, e.g., a color, symbol, or other designation.

This innovative variation in a dice game provides a new concept in dice play, and particularly, dice play aimed at simulating traditional poker card games. As further described below, the invention innovatively provides an exciting game of dice which can follow the rules of traditional poker card play but which does not require repeating suits in a hand to achieve this. More specifically, hands in traditional card poker that require repeating suits (e.g., royal flush and straight flush) are innovatively included in the dice game of the present invention without the use of repeating suits. The game can advantageously also be adapted for use in casino gambling. The invention is also directed to a game set that provides these features.

In an embodiment, the method involves:

(i) having two or more players draw a hand comprised of "m" number of dice wherein "m" is at least three and the same for all players engaged in a play; wherein each die possesses a number of sides, an equivalent number of consecutive numerical values with one numerical value per side, and a suit, the suits being ranked from highest suit rank to lowest suit rank, wherein each side and numerical value in a die is associated with said suit; wherein the dice in a hand are of different suits, none having the same suit, but all of the dice in a hand having the same number of sides and numerical values;

(ii) comparing each hand to an established ranking system of hands to determine the hand of highest rank; and (iii) selecting a winner of a play as the hand of highest rank according to the ranking system of hands;

wherein the ranking system of hands associates numerical values with suit ranks of dice according to a set of rules which provides for at least the following hand ranks:

a "royal flush" corresponds to a hand of dice showing a full set of consecutive numerical values wherein the highest numerical value is associated with the suit of highest rank, and consecutively lower numerical values are associated with suits of consecutively lower rank, the suit of lowest rank associated with the lowest consecutive numerical value, and there being only one combination of numerical values constituting the "royal flush";

a "straight flush" corresponds to a hand of dice showing a full set of consecutive numerical values wherein the highest numerical value is associated with said suit of highest rank, and consecutively lower numerical values are associated respectively with said suits of consecutively lower rank in the same manner as found in the royal flush, and the suit of lowest rank associated with the lowest numerical value in the same manner as found in the royal flush, except that at least one numerical value is different from one of the numerical values of the royal flush, and there being multiple combinations of numerical values constituting a straight flush;

"nothing" corresponds to a hand of dice, which does not contain a repeat of a number, or a full set of consecutive numbers;

wherein the hands in the ranking system of hands are ranked according to the probability of drawing a particular hand, the hand of lowest probability being of highest rank and the hand of highest probability being of lowest rank, except that "royal flush" is always of highest rank and "nothing" is always of lowest rank.

In an embodiment, the method involves the case wherein m takes a value of 3-7 and each player in a play rolls the same m number of dice, and wherein the following sets of rules establish at least the following hand ranks:

a "royal flush" corresponds to a hand of dice showing a full set of consecutive numerical values wherein the highest numerical value is associated with the suit of highest rank, and consecutively lower numerical values are associated with suits of consecutively lower rank, the suit of lowest rank associated with the lowest numerical value, and there being only one combination of numerical values constituting the royal flush;

a "straight flush" corresponds to a hand of dice showing a full set of consecutive numerical values wherein the highest numerical value is associated with said suit of highest rank, and consecutively lower numerical values are associated respectively with said suits of consecutively lower rank in the same manner as found in the royal flush, and the suit of lowest rank associated with the lowest numerical value in the same manner as found in the royal flush, except that at least one numerical value is different from one of the numerical values of the royal flush, and there being multiple combinations of numerical values constituting a straight flush;

a "z of a kind" corresponds to a hand of dice showing equivalent numerical values for "z" number of dice drawn in a hand wherein "z" is at least three and no more than the number of dice "m" drawn in a hand, there being several possible "z of a kind" hands from at least "three of a kind" to "m of a kind" wherein hand ranking increases from "three of a kind" to "m of a kind";

a "straight" corresponds to a hand of dice showing a full set of consecutive numerical values wherein at least one of the numerical values does not possess an association with a suit rank as specified by the straight flush or the royal flush;

For the case when at least five dice are drawn, a "full house" corresponds to a hand of dice having a first set of at least three dice of a first equivalent numerical value and a second set of at least two dice of a second equivalent numerical value, wherein the numerical value of the first set is different from the numerical value of the second set, and wherein the total number of dice in a hand constitutes the two sets, i.e., wherein the entire hand constitutes the first and second numerical values;

For the case when at least four dice are drawn, a "two pair" corresponds to a hand of dice showing a first pair of dice of equivalent value and a second pair of dice of equivalent value, wherein the numerical value of the first pair is different from the numerical value of the second pair;

a "one pair" corresponds to a hand of dice showing equivalent numerical values for two of the dice; and "nothing" corresponds to a hand of dice, which does not contain a repeat of a number, or a full set of consecutive numbers.

In another embodiment, the method involves:

(i) having two or more players draw a hand consisting of five dice, wherein each die possesses a number of sides, an equivalent number of consecutive numerical values with one numerical value per side; and a suit for each die wherein each side and numerical value in a die is associated with said suit, and wherein the dice in a hand are of different suits, none having the same suit, but all of the dice in a hand having the same number of sides, wherein the suits are ranked from highest suit rank to lowest suit rank;

(ii) comparing each hand to an established ranking system of hands to determine the hand of highest rank; and (iii) selecting a winner of a play as the hand of highest rank according to the ranking system of hands;

wherein the ranking system of hands associates numerical values with suit ranks of dice drawn by a player according to the following sets of rules to establish the following hand ranks, as presented in order of highest to lowest hand rank:

a "royal flush" corresponds to a hand of dice showing a full set of consecutive numerical values wherein the highest numerical value is associated with the suit of highest rank, and consecutively lower numerical values are associated with suits of consecutively lower rank, the suit of lowest rank associated with the lowest numerical value, and there being only one combination of numerical values constituting the royal flush;

a "straight flush" corresponds to a hand of dice showing a full set of consecutive numerical values wherein the highest numerical value is associated with said suit of highest rank, and consecutively lower numerical values are associated with said suits of consecutively lower rank in the same manner as found in the royal flush, and the suit of lowest rank associated with the lowest numerical value in the same manner as found in the royal flush, except that at least one numerical value is different from one of the numerical values of the royal flush, and there being multiple combinations of numerical values constituting a straight flush;

a "five of a kind" corresponds to a hand of dice showing equivalent numerical values for five of the dice drawn in a hand;

a "four of a kind" corresponds to a hand of dice showing equivalent numerical values for four of the dice drawn in a hand;

a "straight" corresponds to a hand of dice showing a full set of consecutive numerical values wherein at least one of the numerical values does not possess an association with a suit rank as specified by the straight flush or the royal flush;

a "full house" corresponds to a hand of dice having a first set of three dice of equivalent numerical value and a second set of two dice of equivalent numerical value, wherein the numerical value of the first set is different from the numerical value of the second set;

a "three of a kind" corresponds to a hand of dice showing equivalent numerical values for three of the dice;

a "two pair" corresponds to a hand of dice showing a first pair of dice of equivalent value and a second pair of dice of equivalent value, wherein the numerical value of the first pair is different from the numerical value of the second pair;

a "one pair" corresponds to a hand of dice showing equivalent numerical values for two of the dice; and "nothing" corresponds to a hand of dice, which does not contain a repeat of a number, or a full set of consecutive numbers, or a combination not within the foregoing ranking of hands.

BRIEF DESCRIPTION OF THE DRAWING

The patent or application file contains at least one drawing executed in color. Copies of this patent or patent application publication with color drawing(s) will be provided by the Office upon request and payment of the necessary fee.

The features and aspects of the present invention will be better understood by reference to the following description and drawing.

DETAILED DESCRIPTION OF THE INVENTION

Figure 1:
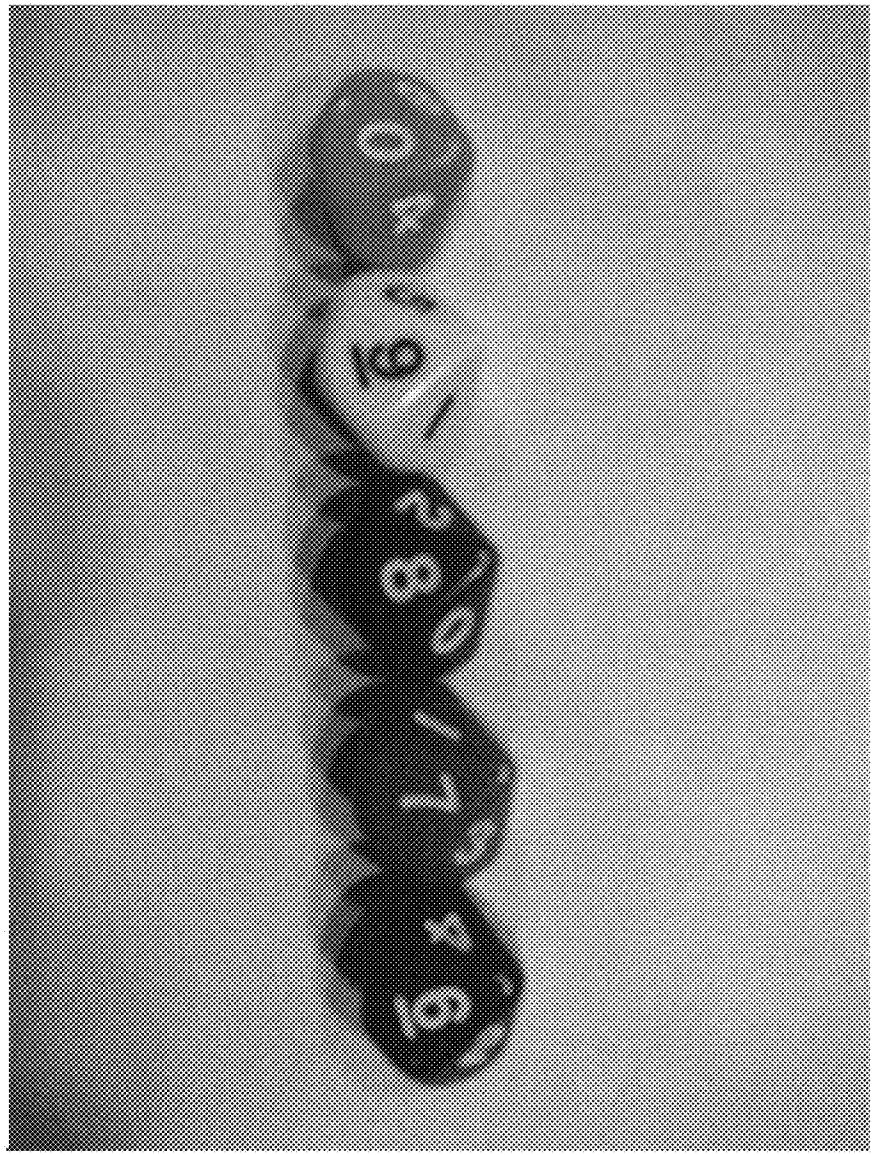
FIG. 1 A color photograph of a set of five ten-sided dice according to the present invention wherein faces of the die are consecutively labeled "0" to "9".

The game begins with each of two or more players drawing a hand of dice ("m" number of dice, wherein "m" is at least three, and more typically five), the number of dice drawn being the same for all players engaged in a play. As used herein, a "hand" of dice is a group of dice rolled (i.e., "drawn") by a player. As used herein, a "play" is a single game for which a winner is determined. Further, as used herein, the term "drawing a hand" refers to the rolling of the dice. The dice may be rolled one at a time in any order, or two may be rolled at one time, or any three rolled at one time, and so on, up to all dice in a hand being rolled at one time. Prior to rolling, the dice may be placed in a container, such as a cup, or in a cage or tumbler. The game is typically played with five dice in order to simulate traditional five-card poker, but the game can be played with less than five (e.g., three, for simulating three-card poker) or greater than five (e.g., six or seven) for playing modified games of poker.

The dice in each hand (or set of dice for a game set) possess the same number of sides (i.e., faces). The dice can possess any convenient number of sides. Typically, the dice are either traditional-sided dice (i.e., cubical dice possessing six sides), or ten-sided (decahedral dice). The dice can also possess a more exotic number of sides, e.g. twelve-sided (dodecahedral) or twenty-sided (icosahedral). In one embodiment, all of the sides of each individual die are the same. In another embodiment, the number of sides on the die is an even number. In another embodiment, the die can have 4, 6, 8, 10, 12, 14, 16, 18, or 20 sides or higher. It is preferred that the die contains 6, 8, 10, 12, 16, or 20 sides, and more preferably, 6, 10, 12, or 20 sides. It is also preferred that the dimensions of each face on a die, e.g., lengths, widths, and area of each face, are the same.

Each die contains a number of consecutive numerical values, wherein the number of consecutive numerical values is equivalent to the number of sides of the die. There is one numerical value indicated per side. For example, a six-sided die may have the numbers "0" to "5" or "1" to "6" indicated on the six sides thereon. Another example is a ten-sided die having the numbers "0" to "9" or "1" to "10" indicated on the ten sides thereon. A numerical value need not be expressed directly as a number, but in any manner by which a numerical value can be correlated, i.e., as a numerical indicator. For example, the numerical indicator can be in the form of pips wherein the number of pips indicates a number. Alternatively, the numerical indicator can be symbolic, e.g., in the form of card faces where each card face is associated with a numerical value. Where the numerical indicator is displayed as a number, the number can be displayed in any suitable form, e.g., as regular numerals, roman numerals, pips, and the like. The dice in each hand (or set of dice for a game set) preferably possess the same set of numerical values.

Each die is also associated with a suit, wherein each side of the die and each numerical value thereon are associated with the same suit. The suit can be indicated in any suitable manner for each die. For example, the suit can be a color, symbol, or wording. Some examples of color suits include red, white, blue, green, and black (for five-dice hands or game sets). The color can be solid or non-solid for a die. Non-solid colors include, for example, stripes, hatching, pixels, or a design. The color suits can also be of the same or similar color with a difference in tint, shade, or tone (e.g., wherein the degree of shading or darkness of the color is the distinguishing factor). Some examples of symbol suits include traditional card suits (e.g., ace, spades, clubs, hearts, and optionally, any one or more additional non-traditional suits). Some examples of wording suits include letter, word, or phrase inscriptions. Some examples of word inscriptions include "B" for "black," "R" for "red," "G" for "green," "W" for "white," and so on.

One example of a die with the foregoing properties is a solid blue six-sided cubical die having the inscription "0" indicated on a first face, "1" indicated on a second face, "2" indicated on a third face, "3" indicated on a fourth face, "4" indicated on a fifth face, and "5" indicated on a sixth face, each face being the same blue color. A set of five dice can be composed of the foregoing blue die, as well as analogous white, black, green, and red die. The same concept can be applied to ten-sided dice wherein, instead, "0" through "9" numerals can be indicated on each die.

A hand of dice drawn by a player (or a set of dice contained in a game set) contains dice in which each of the die is of a different suit, i.e., none of the dice in a hand (or set of dice in a game set) have the same suit. For example, if color is used for designating the suits, a set of five dice may include red, blue, green, black, and white color suits, but not two or more of any of the same color.

According to the game rules of the invention, the suits are ranked from highest suit rank to lowest suit rank, the assigning of ranks being either arbitrarily determined by one or more players, or alternatively, pre-set (i.e., pre-determined) and not determined by the players. For example, the suit ranks can be set by instructions accompanying the game set, or alternatively, by a game of chance (e.g., rolling traditional dice, or flipping coins, or taking lots, or by a machine, as part of a process for assigning rank to the suits). For color suits, the suit ranks may be arbitrarily set as, for example, red being the highest rank, with white, blue, and green being of successively lower rank, and black being of lowest rank.

In much the same way as traditional poker, each hand of dice in a game is compared to an established ranking system of hands to determine the hand of highest rank. The hand of highest rank is considered the winner. Where two or more players are tied with hands of equivalent rank, the tied players can each be deemed winners, or alternatively, additional tie-breaking rules can be applied, as will be discussed further below.

The ranking system of hands associates numerical values with suit ranks of the dice in establishing several of the hand ranks found in card poker. The following sets of rules establish the hand ranks of the present invention:

A "royal flush" corresponds to a hand of dice showing a full set of consecutive numerical values wherein the highest numerical value is associated with the suit of highest rank, and consecutively lower numerical values are associated, respectively, with suits of consecutively lower rank. The suit of lowest rank is associated with the lowest numerical value. There is only one combination of numerical values constituting the royal flush. For example, for a game system employing five ten-sided dice, a "royal flush" may be arbitrarily established as "0" (i.e., "10") associated with red (of highest rank n), "9" associated with white (of rank n−1), "8" associated with blue (of rank n−2), "7" associated with green (of rank n−3), and "6" associated with black (of lowest rank n−4). A hand of dice can only be a "royal flush" when a hand possesses the specific set of numerical values given, with each numerical value associated with a suit as prescribed by the rules established for a "royal flush." For example, for the example given, a hand of dice can only be a "royal flush" if the dice rolled in the hand show the same numerical values as above (i.e., "10" through "6") associated with each suit precisely as given above (i.e., "10" with red, "9" with white, and so on). Accordingly, there is only one unique combination of numerical values and suits that constitute a "royal flush." However, the numerical values that constitute a "royal flush" can be set arbitrarily to any desired set of numbers.

A "straight flush" corresponds to a hand of dice showing a full set of consecutive numerical values wherein the highest numerical value is associated with the suit of highest rank, and consecutively lower numerical values are associated respectively with suits of consecutively lower rank. The suit of lowest rank is associated with the lowest numerical value. The correspondence of numerical value with suit rank is the same as the correspondence found in the "royal flush," except that the "straight flush" contains at least one numerical value different from one of the numerical values of the "royal flush." Unlike the "royal flush," the "straight flush" does not require that a specific set of numerical values be present. Thus, several different hands can constitute a "straight flush" because there can be multiple combinations of numerical values constituting a "straight flush." For example, for a game system employing five ten-sided dice, and wherein a "royal flush" has already been established according to the exemplary color correspondences above, a "straight flush" can contain, for example, the highest number in a hand (e.g., "7") associated with red (of highest rank n), next highest number (e.g., "6") associated with white (of rank n−1), next highest number "5" associated with blue (of rank n−2), next highest number "4" associated with green (of rank n−3), and lowest number "3" associated with black (of lowest rank n−4). Some other examples of a "straight flush" include "9", "8", "7", "6", and "5", associated, respectively, with red, white, blue, green, and black; or, for example, "5", "4", "3", "2", and "1"", associated, respectively, with red, white, blue, green, and black.

A "z of a kind" (i.e., "number of a kind") type of hand corresponds to a hand of dice showing equivalent numerical values for "z" number of dice in a hand, wherein "z" is at least "three" and no more than the number of dice "m" drawn in a hand. For every number of dice "m" being used, there is at least a "three of a kind" and up to "m of a kind" types of "z of a kind" hands possible when "m" is the number of dice utilized in the game. The "z of a kind" hand ranking does not require any particular association of the numerical values with suits. A "three of a kind" is the only "z of a kind" possible if three dice are used. If three six-sided dice are used, some possible "three of a kind" hands include (6, 6, 6), (5, 5, 5), (4, 4, 4), (3, 3, 3), (2, 2, 2), and (1, 1, 1), i.e., if numerical indicators of "1" to "6" are used. If four dice are used, a "four of a kind" and "three of a kind" are the only "z of a kind" hands possible. For a system using four six-sided dice, some examples of "four of a kind" hands include (5, 5, 5, 5), (4, 4, 4, 4), (3, 3, 3, 3), (2, 2, 2, 2), (1, 1, 1, 1), and (0, 0, 0, 0), and some examples of "three of a kind" include (5, 5, 5, 2), (3, 3, 3, 0), (2, 2, 2, 3), (1, 4, 1, 1), and so on, i.e., if numerical indicators of "0" to "5" are used. If five dice are used, "five of a kind," "four of a kind," and "three of a kind" hands are all possible. If six dice are being used, there would also be possible a "six of a kind" hand, and so on. As shown above, there are multiple possible combinations constituting each "z of a kind." The hand ranking of a "z of a kind" hand increases with higher z with "three of a kind" being of lowest rank and "m of a kind" being of highest rank. For example, a "five of a kind" is of higher rank than "four of a kind," which is of higher rank than "three of a kind."

A "straight" corresponds to a hand of dice showing a full set of consecutive numerical values wherein at least one of the numerical values does not possess an association with a suit rank as specified by the "straight flush" or the "royal flush." For example, in the case of five ten-sided dice, if "royal flush" is defined as "0" red, "9" white, "8" blue, "7" green, and "6" black, then one possible "straight" is "0" white, "9" red, "8" blue, "7" green, and "6" black. Another possible "straight" is "5" white, "4" blue, "3" green, "2" red, and "1" white. It is important to note that if the numbers of the "straight" are re-arranged such that highest to lowest numbers are associated, respectively, with highest to lowest suit rank, then the hand is no longer a "straight," but rather, a "straight flush," or possibly a "royal flush" if the numbers match those found in a "royal flush." Thus, a "straight" is a hand having consecutive numerals other than a "straight flush" or "royal flush," as defined.

For the case when at least five dice are drawn, a "full house" corresponds to a hand of dice having a first set of at least three dice of equivalent numerical value and a second set of at least two dice of equivalent numerical value, wherein the numerical value of the first set is different from the numerical value of the second set. In a full house, the entire hand constitutes the first and second numerical values. From the above definition, it is evident that a "full house" is not possible for a three-dice or four-dice system of play. For a system employing five ten-sided dice, some examples of a "full house" include (8, 8, 8, 3, 3), (2, 2, 2, 0, 0), and (1, 3, 1, 1, 3). Since a "full house" requires that the entire hand constitutes the first and second numerical values, the hand (8, 8, 8, 3, 3, 6), for example, for a six-dice game, would not constitute a "full house" since it contains a third value (i.e., "6"). The "full house" hand ranking does not require any particular association of the numerical values with suits.

If five dice are used, a "full house" corresponds to a hand having a first set of dice of a first value and a second set of dice of a second value different from the first value. If more than five dice are used, in one embodiment a "full house" corresponds to a hand wherein the dice are of two different values, a first value and a second value, wherein there are at least two dice of one of the values and three dice of the other value. According to the foregoing rule, (2, 2, 7, 7, 7, 7, 7, 7), (2, 2, 2, 7, 7, 7, 7, 7), and (2, 2, 2, 2, 7, 7, 7, 7) all represent "full house" hands. In another embodiment, if more than five dice are used, a "full house" corresponds to a hand wherein the dice are of two different values, a first value and a second value, wherein either i) the number of dice showing the first value is the same as the number of dice showing the second value (as only applicable to even hands of dice), or ii) the number of dice showing one of the values is one less than the number of dice showing the other value (as only applicable to odd hands of dice). For example, if eight dice are used having 10 equal sides, the hand (4, 4, 4, 4, 6, 6, 6, 6) may be considered a "full house" whereas the hand (4, 4, 4, 4, 4, 4, 6, 6) may not be considered a "full house." As another example, if seven dice are used, the hand (2, 2, 2, 2, 1, 1, 1) may be considered a "full house" whereas the hand (2, 2, 2, 2, 2, 1, 1) may not be considered a "full house."

For the case when at least four dice are drawn, a "two pair" corresponds to a hand of dice showing a first pair of dice of equivalent value and a second pair of dice of equivalent value, wherein the numerical value of the first pair is different from the numerical value of the second pair. For a system employing five ten-sided dice, some examples of "two pair" hands include (8, 8, 2, 3, 3), (2, 2, 9, 0, 0), and (1, 3, 1, 8, 3). The "two pair" hand ranking does not require any particular association of the numerical values with suits.

A "one pair" corresponds to a hand of dice showing equivalent numerical values for two of the dice, and does not require any particular association of the numerical values with suits. For a system employing five ten-sided dice, some examples of "one pair" hands include (8, 8, 2, 3, 5), (2, 2, 9, 0, 4), and (1, 3, 6, 8, 3).

A "nothing" corresponds to a hand of dice, which does not contain a repeat of a number or a full set of consecutive numbers. Typically, a "nothing" corresponds to a hand of dice showing a combination not within any of the hand ranks being used for a game. For a system employing five ten-sided dice, some examples of "nothing" hands include (8, 0, 2, 3, 5), (2, 1, 9, 0, 4), and (1, 3, 6, 8, 5).

The hands in the ranking system of hands are ranked according to the probability of drawing a particular hand, wherein the hand of lowest probability is of highest rank and the hand of highest probability is of lowest rank, except that "royal flush" is always of highest rank and "nothing" is always of lowest rank. The probability of drawing different hand types can be readily calculated according to mathematical formulae well known in the art.

For a system employing five dice, the ranking system of hands preferably includes the following types of hands, as ranked from highest to lowest: "royal flush," "straight flush," "five of a kind," "four of a kind," "straight," "full house," "three of a kind," "two pair," "one pair," and "nothing." For a system employing three dice, the ranking system of hands preferably includes the following types of hands, as ranked from highest to lowest: "royal flush," "straight flush," "straight," "three of a kind," "one pair," and "nothing."

It is important to note that a hand of "flush" is not provided by the dice game described herein, since a "flush" would require a showing of the same suit for all dice. However, the game disclosed herein requires all dice in a hand to be of different suits.

The inventor also contemplates that the game can be modified by including a new type of hand rank not shown above, and which is within the general concept and framework of the game as lay out. For example, it may be possible to include a hand rank between "straight flush" and "royal flush" wherein a hand of dice shows all of the same numbers of a royal flush but wherein at least a pair of numbers therein are not associated with suits in the same manner as in the royal flush, e.g., "0" white, "9" red, "8" blue, "7" green, and "6" black, where a "royal flush" has been established as "0" red, "9" white, "8" blue, "7" green, and "6" black. If desired, such a hand can be considered of higher rank than a "straight flush" and below a "royal flush," and be given any desired designation, such as, for example, "semi-royal flush" or "super straight flush." Other types of hand ranks can be included based on other principles. Alternatively, one or more of the hand ranks can be excluded or considered equivalent in rank to another hand rank for one or more games. Numerous other modifications are possible while keeping within the scope of the game described herein.

For dice hands containing greater than five dice, additional types of hands may be possible which have not already been enumerated above. For example, a six-dice game may include a "three-pair" type of hand, e.g., (2, 2, 4, 4, 7, 7) or a four of a kind and a pair, e.g., (3, 3, 3, 3, 8, 8); or a seven-dice game may include a type of hand combining a "three of a kind" and a "three of a kind," e.g., (4, 4, 4, 7, 5, 5, 5); or an eight-dice game may include a "four-pair" type of hand, e.g., (2, 2, 3, 3, 6, 6, 9, 9), and so on. It is also possible for certain type of hands to be classified under different hand ranks. For example, (4, 4, 4, 5, 5, 5, 5) can be classified as a "three of a kind," "four of a kind," or "three of a kind and four of a kind," or "full house." The classification rules for games using more than five dice are arbitrarily determined. The ranking order of the hands is established according to the probability of drawing a particular hand, the hand of lowest probability being of highest rank and the hand of highest probability being of lowest rank, except that "royal flush" is always of highest rank and "nothing" is always of lowest rank.

The dice game described herein may also be modified as a community dice game. For example, the game may be organized by first providing a certain number of community dice before having each player draw a hand of dice. Then each player is provided the opportunity to exchange one or more dice in a hand with the same number of community dice, wherein each exchange of dice involves exchanging dice of the same suit. For example, the game may be a five dice game in which one community blue die is first provided. Then each player rolls five dice of color suits red, white, blue, green, and black. Each player is then given the opportunity to exchange his or her blue die (i.e., the value shown by the blue die in the hand) with the community blue die (i.e., with the value shown by the blue community die). Alternatively, if "m" is taken as the total number of dice being played in a hand (i.e., "m" represents a full hand), wherein "m" is an integer of at least 3 and preferably 3-8, there can be provided "r" number of dice as community dice, and each player thereafter given the opportunity to roll "m-r" dice, where r is an integer having a value less than n; r ranges from 1 to m−1. Each player then has the opportunity to combine his or her "m-r" dice with the "r" community dice to make a full hand. The "r" community dice being used need to be of different suits than the "m-r" dice rolled for each player. For example, the game may be a community five-dice game in which two community dice of color suits blue and green are first provided. Then each player rolls three dice of color suits white, red, and black in order to combine with the community dice given. Numerous other embodiments are possible in adapting the game as a community-based game.

If desired, it is possible for a numerical indicator to represent either of two different numbers depending on the numbers drawn in a hand. For example, the number "0" can function as "10" in order to complete the consecutive list of numbers if the remaining dice show "9", "8", "7", and "6", but function as "0" in order to complete a consecutive list of numbers if the remaining dice show "1", "2", "3", and "4".

In a variation of the game described herein, it is also possible to include the equivalent of a "wild card" by including one or more "wild dice." In one embodiment, a "wild die" is constructed of any of the dice described above wherein one or more of the sides are blank and at least one side contains a value (e.g., number). The wild dice has the same number of faces as the other dice used in the game. When rolled in a hand, the "wild die" can either show a blank face or a design on one of the faces. A blank face on the "wild die" can be taken as nothing (i.e., as if the "wild die" had not been included). A design on the face on the "wild die" can be taken as an arbitrary number determined by the player who rolled the "wild die" to replace another number drawn in the hand. This is analogous to a Joker or other wild card used in a poker card game.

The wild die can be in the form of a Joker (i.e., "Joker die"), which would function in the same manner as a Joker card as used in card poker. As used in the dice game described herein, the Joker can take any numerical value. Since the Joker is used to replace one of the dice, the suit associated therewith is of any suit, i.e., it is of the same suit as the die being substituted. In one embodiment, the Joker is included by including in a hand at least one die which includes at least one face as a Joker face. In this embodiment, the Joker can be included in a hand by including an extra die having at least one Joker face and at least one blank face and rolling the wild dice with the other dice. If design or other designation as a Joker is rolled, the Joker die can replace one or the other die used, where it takes whatever numerical values which the player wishes in order to improve the value of his hand and wherein the Joker die adopt the suit of the die which it replaces. For example, if a five-dice game is being played, each hand can include five regular dice and an extra wild die containing one or two Joker faces and the rest being blank faces. If the Joker were rolled, it would then replace one of the other dice in the hand, taking any numerical value and taking the suit of the die it replaces.

Other variations are possible and contemplated within the scope of the present invention. For example, other numerical values can function as wild values in poker game variants of the present invention. For example, there can be provided a numerical value such as deuces in which a deuce (i.e., "2") is the equivalent of the Joker described hereinabove and in which it can represent any value. Numerous other ways of including wild values are possible, and are contemplated to be within the scope of the present invention.

Typically, the game requires each player to input at least one wager per play prior to rolling dice. The wager can be any type, i.e., actual money, tokens, playing chips, and the like, or combinations thereof. The winner of a play receives at least a portion of the total amount waged in a play. In one embodiment, a player having a winning hand of any ranking wins the sum of all wagers (i.e., "the pot") entered in the play. For example, in a game of four players where one player scores a "five of a kind", two players each score a "two pair", and one player scores a "one pair", the player scoring the "five of a kind" wins the pot. In another embodiment, an initial pot of wagers is inputted by the house (i.e., gambling establishment) and each player enters one or more wagers to add to the pot. A winner of a play then receives a portion of the total pot based on the hand rank of the winning hand. For example, a "royal flush" may net a winner 100% of the pot or a set dollar amount, while a "five of a kind" may net a winner 50% of the pot or a set dollar amount less than a dollar amount for a "royal flush." In yet another embodiment, there is provided a pot of non-tender wagering objects, such as playing chips, from which a winner from each play receives a fixed amount depending on the hand rank of the winning hand. For example, a "royal flush" may net 50 chips, a "straight flush" 30 chips, a "five of a kind" 20 chips, a "four of a kind" 15 chips, and so on. Alternatively, a point system can be used without chips. After a set number of plays, the player possessing the most chips or points is deemed the winner. The system for distributing and/or apportioning chips, and conducting other aspects of the game, can also be adapted to be mechanized or computerized.

In the event of a tie between two or more players, tie-breaking rules can be applied in order to break the tie and establish a winner. For example, in a tie between two or more hands of the same hand rank other than "royal flush" and wherein the tied hands differ in the value of the highest numerical value, there can be implemented a rule that the player possessing the highest numerical value is deemed the winner. For example, in the event that a first and second player possess a "straight" hands of (7, 6, 5, 4, 3) and (5, 4, 3, 2, 1), respectively, the first player wins because the highest number of that hand is greater, i.e., "7" is greater than "5". For a tie involving "m of a kind" hands, the repeating numbers are typically considered first. For example, for first and second players possessing "three of a kind" hands of (3, 3, 3, 5, 7) and (5, 5, 5, 3, 7), respectively, the second player wins since "5" is greater than "3". Alternatively, if two players possess "m of a kind" hands in which the repeating numbers of each hand are equivalent, the "kicker" numbers (i.e., those outside of the three equivalent numbers) can be used to break the tie by selecting the winner with the greatest kicker number. For example, for two players possessing (5, 5, 5, 6, 7) and (5, 5, 5, 6, 8), the latter player wins since "8" is greater than "7". Typically, the number "0" counts as the highest number "10". However, if "0" is allowed to represent the lowest possible number in a hand (i.e., "0" and not "10"), then in the event of a tie the "0" is typically still counted as the lowest number. However, such rules can be modified and are arbitrary.

In the event that the two or more players in a tie possess hands of the same highest number associated with the same suit, the tie can be broken by considering the next highest number in each hand. For example, if a first player draws the hand ("6" blue, "7" green, "6" black, "2" red, "1" white) and a second player draws the hand ("6" red, "7" green, "6" black, "4" blue, "1" white), and assuming the suits are ranked from highest to lowest as red, white, blue, green, and black, the second player wins because his or her next highest number ("6") is greater than the next highest number of the first player ("3"). Alternatively, in hands having repeating numbers (as in the foregoing example), only the repeating numbers are first compared. For example, in the previous example, the first and second players contain, respectively, a pair of "3"s and a pair of "6"s. The second player can be deemed the winner on this basis since his pair of "6"s is greater than the first player's pair of "3"s.

In the event that two or more players in a tie possess hands of the combination of numbers (e.g., 7, 7, 7, 3, 4 and 7, 7, 7, 3, 4), the tie cannot be broken based on a highest number. In this event, the tie is preferably broken by consideration of the suit rank of the highest numerical value in each hand. Thus, if red is considered of highest suit rank and a first player draws the hand ("3" blue, "3" green, "3" black, "2" red, "1" white) and a second player draws the hand ("3" red, "3" green, "3" black, "2" blue, "1" white), the second player wins because the higher number ("3") in that hand is associated with a suit of higher rank (i.e., red) than the suits associated with the three "3"s in the hand of the first player.

In the tie-breaking rules described above, numerical value was given priority over suit rank. In other words, a highest numerical value in a group of tied hands establishes the winner, unless the numerical combinations are the same, at which point suit rank of the highest numerical value is considered. However, the tie-breaking rules can consider numbers and suit ranks according to alternative priorities. For example, the tie-breaking rules may provide that, after a tie is found and if the highest numbers of each hand are equivalent, the rank of each highest number are considered at that point before considering the next highest number. Thus, for example, if red is taken as the color of highest rank, and if a first player draws the hand ("6" blue, "7" green, "6" black, "2" red, "1" white) and a second player draws the hand ("6" red, "7" red, "6" black, "4" blue, "1" white), the second player wins according to these rules because the "7" red has a higher rank than the "7" green. In the event that the highest numbers are the same and of the same suit, the next highest number can be considered. The hand with the higher next-highest number wins. In the event that the next-highest numbers are the same, then the suit rank of the next-highest numbers are considered, and the hand with the higher suit rank wins, and so on.

In the event that the two or more players in a tie possess hands of precisely the same combination of numbers, with each number associated with the same suit from hand to hand (e.g., as in a tie of "royal flush" hands), the tie preferably results in all of the tied players being deemed winners. In doing so, the tied winners preferably split the pot.

However, in the event that each of the hands of the players contain "nothing," then arbitrary rules can be set up to address this situation. For example, in one embodiment, the pot is evenly split between tied players. In another embodiment, the pot remains intact as each player is asked to put in another bet. In another embodiment, the highest card in a group of "nothing" hands may be considered the winner. If a tie still remains, the highest card with the highest suit rank (e.g., highest ranking color) can be considered the winner. The rules for determining how to handle these situations are predetermined prior to playing the game.

The invention is also directed to a game set constructed for playing the dice game described above. In a preferred embodiment, the game set contains at least two sets of "m" number of dice wherein "m" is at least three and equivalent for at least two sets of dice. Preferably, there are five dice for each set (i.e., m=5). The dice possess the properties described above, e.g., an equal number of consecutive numerical values with one numerical value per side, and a suit associated with each die. Preferably, the suits are indicated by a color possessed by each die. The dice in a set contain the same number of sides and numerical values, but are of different suits (e.g., colors), none of the dice in a set having the same suit. A game set also contains a set of instructions describing the rules of the game as set forth above. The set of instructions can be in any form, including as an insert, or printed on the container holding the game set.

The game set may also include a game board. The game board can either be simple in form, or include one or more amenities, such as indications for where players should roll dice, location for placing wagers, rules of the game, and so on. The game set can also include any number of objects useful for wagering, such as wagering chips (playing chips). The game set can include any other amenities, which can function to improve the game or make the game more convenient or enjoyable. For example, the game set can include a receptacle for inputting wagers (e.g., on the game board), or a cup or other container for mixing and/or rolling dice, or a dice tumbler.

Examples have been set forth below for the purpose of illustration and to describe the best mode of the invention at the present time. However, the scope of this invention is not to be in any way limited by the examples set forth herein. Numerous other modifications to the game are possible and contemplated herein.

Example

Hand Ranking System For Five-Dice Hands Using Ten-Sided Dice

The following hand ranking system (along with examples) was established using a set of five ten-sided dice, each die in the set having a unique color to represent a suit. The selected colors and their arbitrarily assigned ranks were as follows: red (highest rank), white (next highest), blue (next highest), green (next highest), and black (lowest rank). Each die in the set possessed sides labeled "0" (i.e., signifying "10") through "9", with each label to a side. Accordingly, the following table shows the ranking order of hands and an example for each type of hand.

Examples of Hand Rankings

| Hand Ranking (from highest to lowest rank) | Example of a Hand Showing the Indicated Hand Rank | Number of Possible Permutations Resulting in the Indicated Hand Rank | Probability of Drawing a Hand of the Indicated Hand Rank |
|---|---|---|---|
| Royal Flush | "0" red, "9" white, "8" blue, "7" green, "6" black | 1 | 0.000010 |
| Straight Flush | "7" red, "6" white, "5" blue, "4" green, "3" black | 5 | 0.000050 |
| Five of a Kind | "7" red, "7" white, "7" blue, "7" green, | 10 | 0.000100 |

-continued

| Hand Ranking (from highest to lowest rank) | Example of a Hand Showing the Indicated Hand Rank | Number of Possible Permutations Resulting in the Indicated Hand Rank | Probability of Drawing a Hand of the Indicated Hand Rank |
|---|---|---|---|
| | "7" black | | |
| Four of a Kind | "7" red, "7" white, "7" blue, "7" green, "0" black | 450 | 0.004500 |
| Straight | "2" red, "5" white, "4" blue, "3" green, "1" black | 714 | 0.007140 |
| Full House | "7" red, "7" white, "7" blue, "0" green, "0" black | 900 | 0.009000 |
| Three of a Kind | "1" red "2" white, "7" blue, "7" green, "7" black | 7200 | 0.072000 |
| Two Pair | "1" red, "2" white, "2" blue, "5" green, "5" black | 10,800 | 0.108000 |
| One Pair | "1" red, "2" white, "3" blue, "7" green, "7" black | 50,400 | 0.504000 |
| Nothing | "0" red, "9" white, "5" blue, "3" green, "8" black | 29,520 | 0.295200 |

While there have been shown and described what are presently believed to be the preferred embodiments of the present invention, those skilled in the art will realize that other and further embodiments can be made without departing from the spirit and scope of the invention described in this application, and this application includes all such modifications that are within the intended scope of the claims set forth herein.

What is claimed is:

1. A game set for playing a modified game of poker using dice, the game set comprising:

(i) at least one set of "m" number of dice wherein "m" is at least three, each of the dice possessing the same number of sides, an equivalent number of consecutive numerical values with one numerical value per side of each dice, and a suit, wherein each side and numerical value of dice are associated with said suit; wherein the dice in a set contain the same number numerical values, and are of m number of different suits, and not two of the dice having the same suit, said numerical values being regular numerals, Roman numerals or pips; and (ii) a set of instructions describing the rules of the game, wherein the rules comprise:

(a) having two or more players draw a hand comprised of "m" number of dice in said set of dice wherein "m" is at least three and the same for all players engaged in a play;

(b) comparing each hand to an established ranking system of hands to determine the hand of highest rank; and (c) selecting a winner of a play as the hand of highest rank according to the ranking system of hands;

wherein the ranking system of hands ranks suits from highest suit rank to lowest suit rank and associates numerical values with said suit ranks according to a set of rules which provides for at least the following hand ranks:

a "royal flush" corresponds to a hand of dice showing a full set of consecutive numerical values wherein the highest numerical value is associated with the suit of highest rank, and consecutively lower numerical values are associated with suits of consecutively lower rank, the suit of lowest rank associated with the lowest consecutive numerical value, and there being only one combination of numerical values constituting the "royal flush";

a "straight flush" corresponds to a hand of dice showing a full set of consecutive numerical values wherein the highest numerical value is associated with said suit of highest rank, and consecutively lower numerical values are associated respectively with said suits of consecutively lower rank in the same manner as found in the royal flush, and the suit of lowest rank associated with the lowest numerical value in the same manner as found in the royal flush, except that at least one numerical value is different from one of the numerical values of the royal flush, and there being multiple combinations of numerical values constituting a straight flush;

"nothing" corresponds to a hand of dice, which does not contain a repeat of a number, or a full set of consecutive numbers;

wherein the hands in the ranking system of hands are ranked according to the probability of drawing a particular hand, the hand of lowest probability being of highest rank and the hand of highest probability being of lowest rank, except that "royal flush" is always of highest rank and "nothing" is always of lowest rank.

2. The game set of claim 1, wherein "m" is five.

3. The game set of claim 1, wherein the suits are indicated by a color of each of the dice.

4. The game set of claim 1, wherein the dice are six-sided dice.

5. The game set of claim 4, wherein each six-sided dice contains consecutive numerical values of "0" through "5" or "1" through "6".

6. The game set of claim 1, wherein the dice are ten-sided dice.

7. The game set of claim 6, wherein each of the ten-sided dice contains consecutive numerical values of "0" through "9" or "1" through "10".

8. The game set of claim 1, further comprising a number of objects used for wagering.

9. The game set of claim 8, wherein the objects are wagering chips.

10. The game set of claim 1, further comprising a game board.

11. The game set of claim 10, wherein the game board includes indications for where individual players should roll dice.

12. The game set of claim 10, wherein the game board includes a place for players to input wagers.

13. The game set of claim 1, further comprising a container or tumbler for mixing and/or rolling dice.

14. The game set of claim 1, wherein one or more "wild dice" are included, the "wild dice" having one or more "wild sides" containing a "wild value" that can be taken as any desired value, and at least one blank face.

15. The method of claim 14, wherein the "wild value" is a Joker.

16. The method of claim 15, wherein the Joker is on one or two faces of the wild dice with the remaining faces being blank.

17. A game set for playing a modified game of poker using dice, the game set comprising:

(i) at least one set of five dice, each of the dice possessing the same number of sides, an equivalent number of consecutive numerical values with one numerical value per side of each dice, and a suit, wherein each side and numerical value of each of the dice are associated with said suit; wherein the dice in a set contain the same numerical values, and are of five different suits, none of the dice having the same suit; and said numerical values being regular numerals, Roman numerals or pips; and (ii) a set of instructions describing the rules of the game, wherein the rules comprise:

(a) having two or more players engaged in a play each draw a hand comprised of five dice of said set of five dice;

(b) comparing each hand to an established ranking system of hands to determine the hand of highest rank; and (c) selecting a winner of a play as the hand of highest rank according to the ranking system of hands;

wherein the ranking system of hands ranks suits from highest suit rank to lowest suit rank and associates numerical values with said suit ranks according to a set of rules which provides for at least the following hand ranks, as presented in order of highest to lowest hand rank:

a "royal flush" corresponds to a hand of dice showing a full set of consecutive numerical values wherein the highest numerical value is associated with the suit of highest rank, and consecutively lower numerical values are associated with suits of consecutively lower rank, the suit of lowest rank associated with the lowest numerical value, and there being only one combination of numerical values constituting the royal flush;

a "straight flush" corresponds to a hand of dice showing a full set of consecutive numerical values wherein the highest numerical value is associated with said suit of highest rank, and consecutively lower numerical values are associated with said suits of consecutively lower rank in the same manner as found in the royal flush, and the suit of lowest rank associated with the lowest numerical value in the same manner as found in the royal flush, except that at least one numerical value is different from one of the numerical values of the royal flush, and there being multiple combinations of numerical values constituting a straight flush;

a "five of a kind" corresponds to a hand of dice showing equivalent numerical values for five of the dice drawn in a hand;

a "four of a kind" corresponds to a hand of dice showing equivalent numerical values for four of the dice drawn in a hand;

a "straight" corresponds to a hand of dice showing a full set of consecutive numerical values wherein at least one of the numerical values does not possess an association with a suit rank as specified by the straight flush or the royal flush;

a "full house" corresponds to a hand of dice having a first set of three dice of equivalent numerical value and a second set of two dice of equivalent numerical value, wherein the numerical value of the first set is different from the numerical value of the second set;

a "three of a kind" corresponds to a hand of dice showing equivalent numerical values for three of the dice;

a "two pair" corresponds to a hand of dice showing a first pair of dice of equivalent value and a second pair of dice of equivalent value, wherein the numerical value of the first pair is different from the numerical value of the second pair;

a "one pair" corresponds to a hand of dice showing equivalent numerical values for two of the dice; and "nothing" corresponds to a hand of dice showing a combination not within the foregoing ranking of hands.

* * * * *